US007261614B2

(12) United States Patent
Laurienzo et al.

(10) Patent No.: US 7,261,614 B2
(45) Date of Patent: Aug. 28, 2007

(54) STUNT RAMP FOR WHEELED TOY DEVICE

(75) Inventors: Dominic Laurienzo, Malibu, CA (US); Brendon Vetuskey, Malibu, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 0 days.

(21) Appl. No.: 11/180,953

(22) Filed: Jul. 12, 2005

(65) Prior Publication Data

US 2007/0015594 A1 Jan. 18, 2007

(51) Int. Cl.
*A63H 18/02* (2006.01)

(52) U.S. Cl. ..... 446/444; 472/89; 14/69.5

(58) Field of Classification Search ..... 472/88–91; 446/429, 431, 444; 14/69.5
See application file for complete search history.

(56) References Cited

U.S. PATENT DOCUMENTS 4,129,916 A * 12/1978 Schlesinger et al. ..... 14/69.5
4,394,961 A 7/1983 Muller ..... 238/10 R
4,519,789 A 5/1985 Halford et al. ..... 446/444
5,524,310 A * 6/1996 Farnen ..... 14/69.5
6,042,480 A * 3/2000 Labelson ..... 472/89
6,350,174 B1 2/2002 Halford et al. ..... 446/444
6,776,685 B2 8/2004 Reisher et al. ..... 446/444

* cited by examiner

*Primary Examiner*—Kien Nguyen
(74) *Attorney, Agent, or Firm*—Richard B. Klar; Law Office of Richard B. Klar

(57) ABSTRACT

A stunt ramp for a wheeled toy vehicle to travel upon and provide from approximately 5 degrees to 180 degrees lift from the surface by the ramp structure. The ramp is made of two end pieces connected to each other by cross braces. The end pieces have grooves adapted to have a ramp sheet slid within the grooves. The end pieces are curved so that when the flexible ramp sheet is adjustably slid into the grooves the ramp sheet will curve as well.

19 Claims, 11 Drawing Sheets

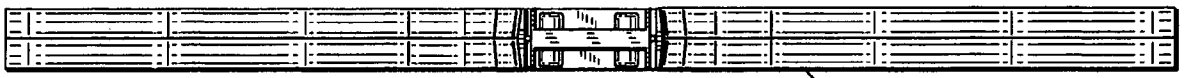
FIG. 6
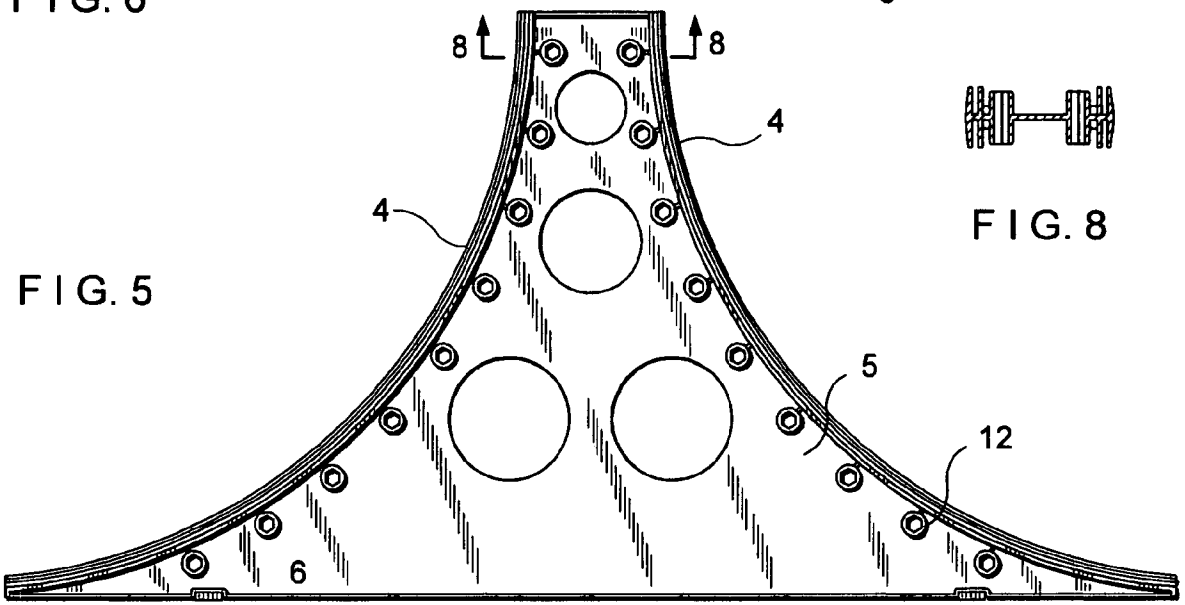
FIG. 5
FIG. 8
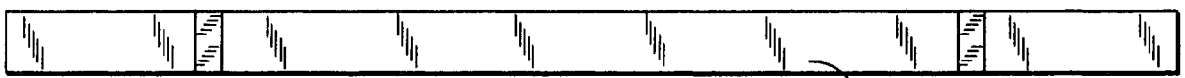
FIG. 7
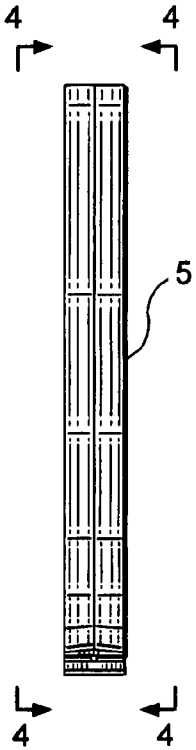
FIG. 4

STUNT RAMP FOR WHEELED TOY DEVICE

BACKGROUND OF THE INVENTION

1. Field of the Invention

The present invention relates to a toy ramp for toy vehicles. In particular, the present invention relates to a toy stunt ramp for wheeled toy vehicles to travel upon.

2. The Prior Art

U.S. Pat. No. 6,776,685 B2 discloses a toy vehicle ramp. The ramp includes elastic bands 50 that stretch across the ramp's front surface and under the ramp sheet as shown in FIG. 3.

U.S. Pat. No. 4,519,789 discloses a ramp structure attached to a track.

U.S. Pat. No. 6,350,174 B1 discloses a bridge-like ramp structure.

U.S. Pat. No. 4,394,961 discloses a track for toy vehicles with jumping-off and jumping-on ramps.

SUMMARY OF THE INVENTION

The present invention relates to a stunt ramp for a wheeled toy vehicle to travel upon and provide from approximately 5 degrees to 180 degrees lift (and extending approximately from 91 degrees to 180 degrees by using a second ramp placed upside down on top of a first ramp) from the surface by the ramp structure. In particular the ramp is made of two end pieces connected to each other by cross braces. The end pieces have grooves adapted to have a ramp sheet slide within the grooves. The end pieces are curved so that when the flexible ramp sheet slides into the grooves the ramp sheet will curve as well.

BRIEF DESCRIPTION OF THE DRAWINGS

FIG. 4 is a -front view of one of the side walls of the FIG. 1;

FIG. 5 is a side view along lines 4-4 of FIG. 3;

FIG. 6 is a top view of FIG. 4;

FIG. 7 is a bottom view of FIG. 4;

FIG. 8 is a sectional view along lines 7-7 of FIG. 4;

DETAILED DESCRIPTION OF THE PREFERRED EMBODIMENTS

Figure 1:
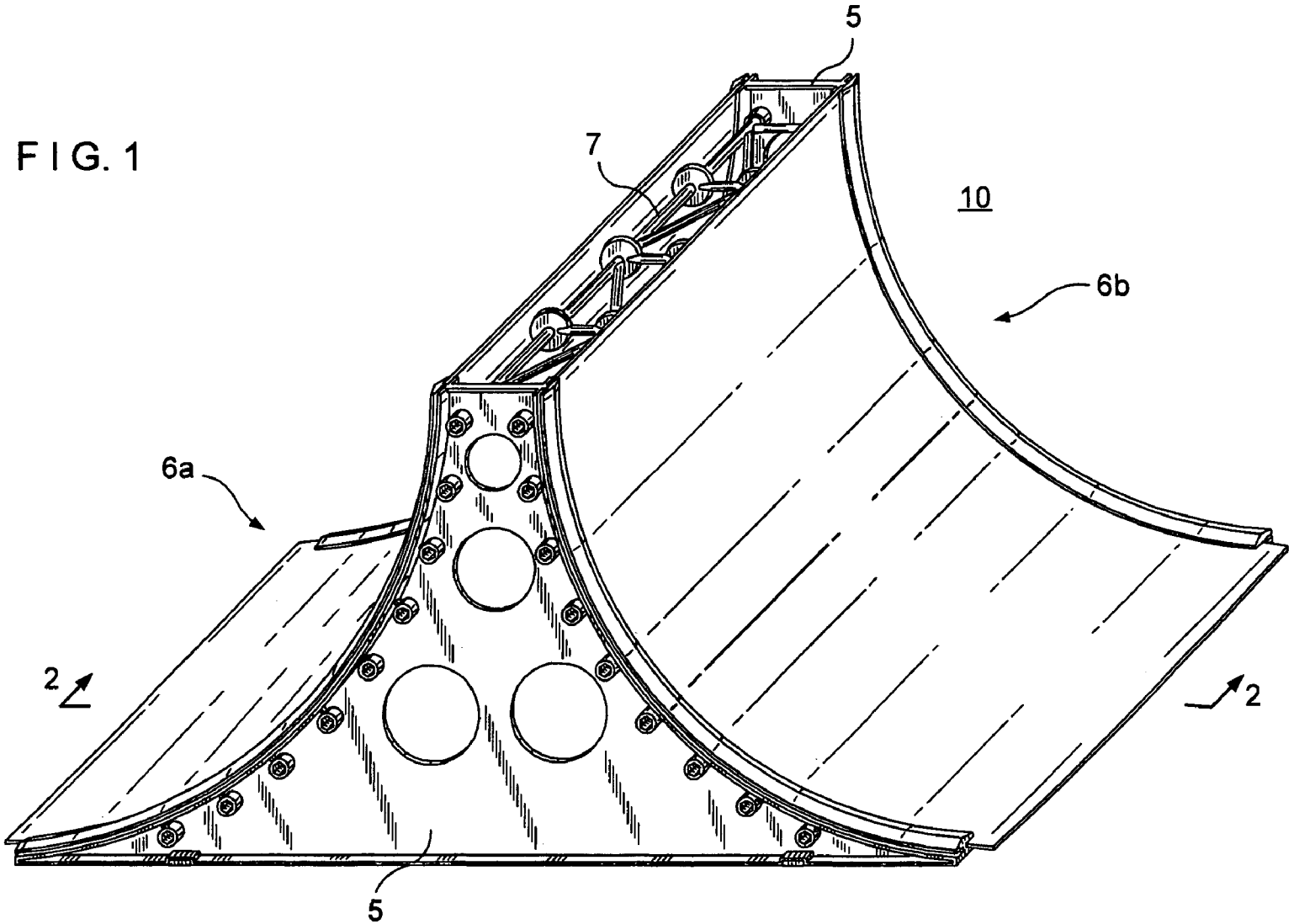
FIG. 1 is a perspective view of a first embodiment of the present invention.

Referring now to the drawings of FIGS. 1-18, FIG. 1 illustrates a first embodiment of the present invention in which a ramp 10 is formed of two side support structures 5, a plurality, preferably three, of cross braces or trusses 7, one or two flexible sheets 8. The ramp structure has two sides 6*a*, 6*b* so that when flexible sheets are provided in each side 6*a*, 6*b* of the ramp the result is two ramps in back to back arrangement so that a child can play on each side 6*a* or 6*b* with one of the ramps. The ramp itself is modular for add on ramps in side by side and on top arrangements as described below.

Figure 2:
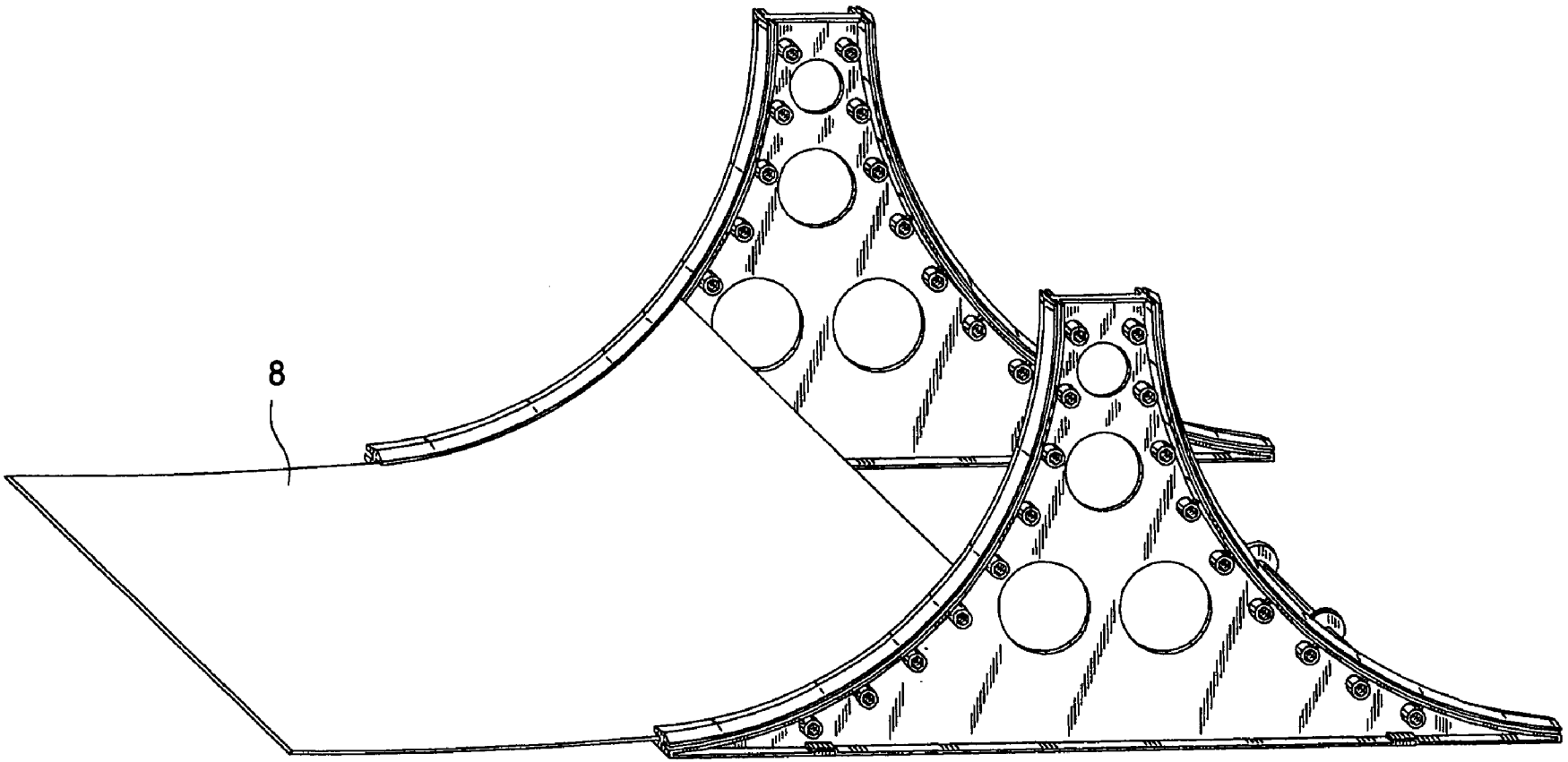
FIG. 2 illustrates how the flexible ramp sheet can slide up or down within the grooves of the side support structures so that the slope of the ramp can be adjusted and how the cross braces can be placed to support the flexible sheet wherever it is positioned by insertion into the appropriate corresponding openings of the side support structures.

FIG. 2 illustrates how the flexible ramp sheet 8 can slide up or down within the grooves of the side support structures. In this way the slope of the ramp can be adjusted between approximately 5 degrees and 90 degrees in this embodiment and between 5 degrees and 180 degrees. In the second embodiment shown in FIG. 16. The cross braces 7 can be placed to support the flexible sheet 8 wherever it is positioned by insertion into the appropriate corresponding openings 12 of the side support structures 5.

Figure 3:
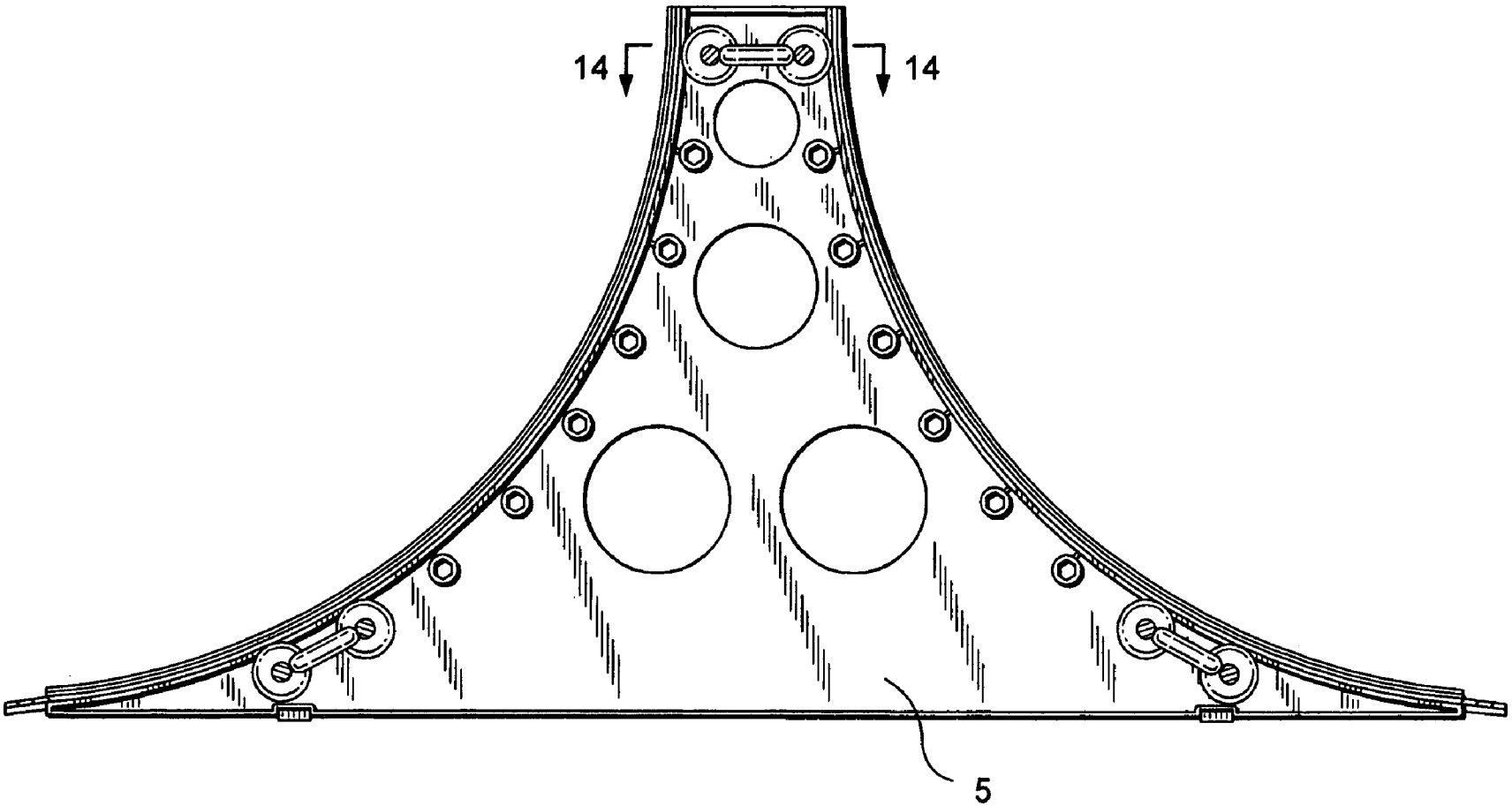
FIG. 3 is a sectional view along lines 2-2 of FIG. 1.
Figure 12:
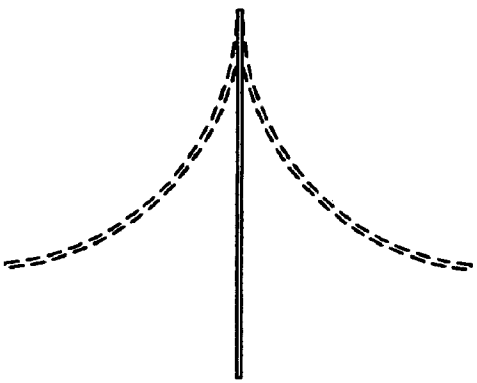
FIG. 12 is a side view of the ramp sheet shown in broken lines as being Curve-shaped in the assembled ramp of the present invention.

FIG. 3 illustrates one of the side support structures 5. As seen in FIG. 3 the three cross braces are connected to the side support structure by securing ends 11 of the cross braces 7 being securing or clamping (to the side support structure 5) the ends 13 of the cross braces 7 that are inserted into openings 12 of the side support structure 5 at each of the three locations of the side support structure 5 as seen in FIG. 12 The side support structures 5 also each have grooves or channels 15 defined within the edges 4 adapted to have one of the edges 3 of a flexible sheet 8 inserted therein so that when a flexible sheet is inserted therein it assumes the upwardly sloping shape of the edges 4 of side support structure 5 of preferably approximately 90 degrees seen in FIG. 1. The locations of the cross braces 7 into the corresponding openings 12 of the side support structures 5 can be changed depending on in what position the flexible ramp sheet 8 is slid into as shown in FIG. 2 so that the cross braces provide adequate support behind the flexible ramp sheet 8. Preferably at least one cross brace is located behind the flexible sheet 8 to provide support for it.

Figure 16:
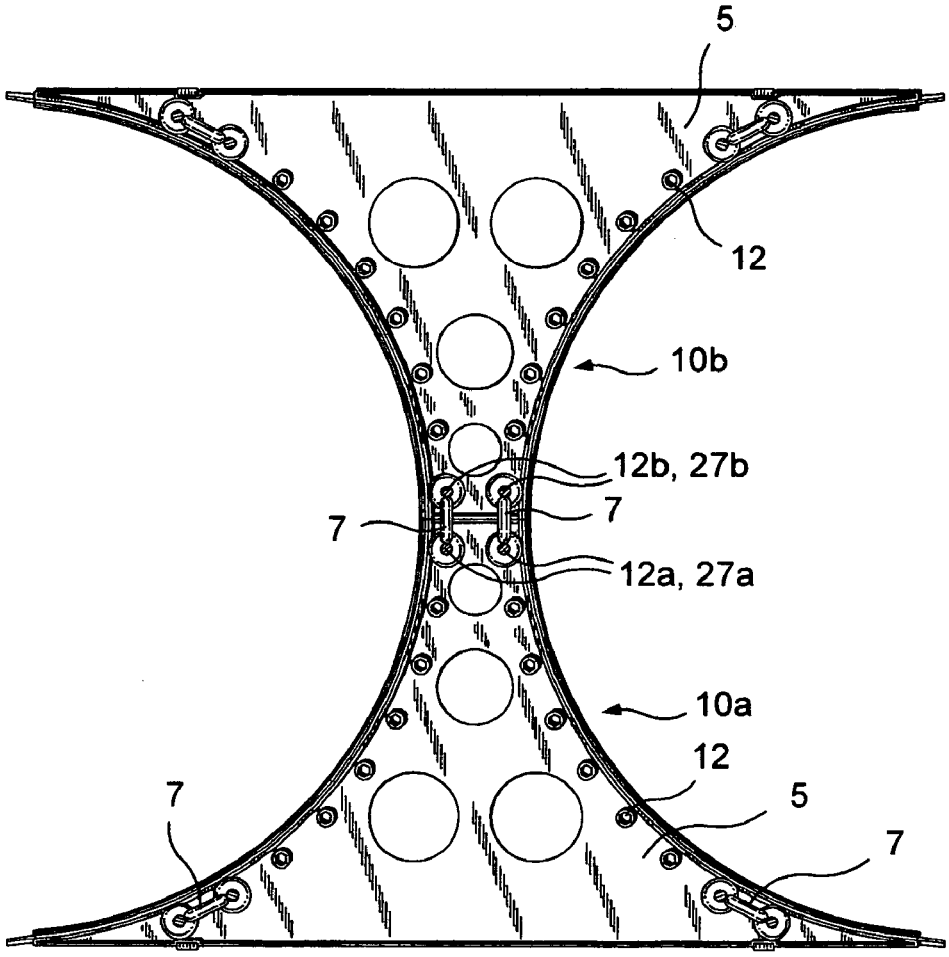
FIG. 16 is a sectional view of a second embodiment of the present invention of the ramp assembled in an inverted C-shaped ramp structure where two of the ramps of the embodiment in FIG. 1 are placed together by placing a second one of these two ramps upside down on top of a first one of these ramps to create an inverted C-shaped ramp with a 180 degree turning capability for the toy vehicle traveling thereon.

As can be seen in FIG. 3, each of the side support structures 5 has a curved, upwardly sloping edge 14, preferably having an upwardly adjustable sloping surface of between approximately 5 degrees and 90 degrees using the embodiment of FIG. 1 (and between approximately 5 degrees and 180 degrees in the embodiment of FIG. 16).

Figure 15:
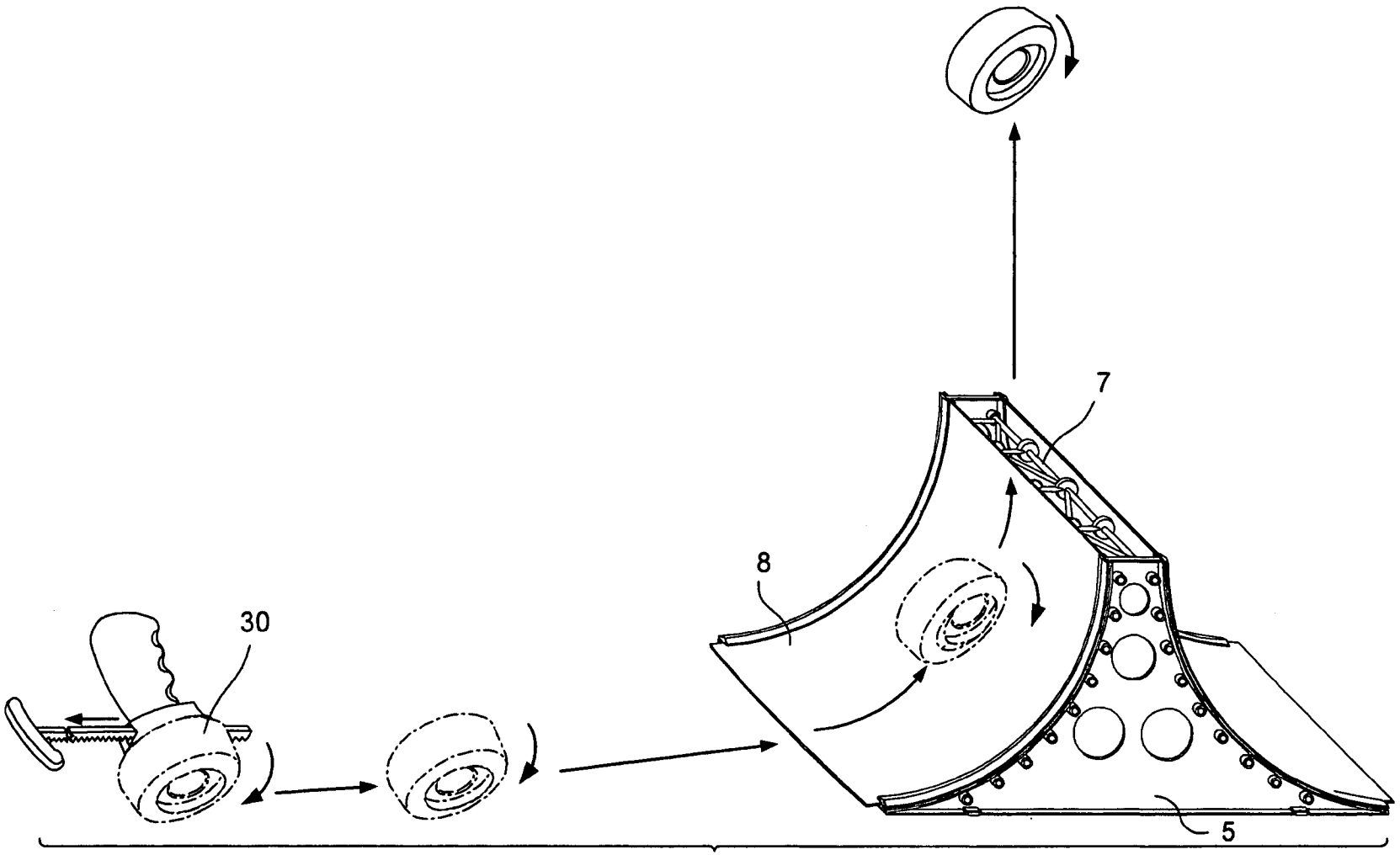
FIG. 15 is an illustration of the ramp and a wheel toy in use in accordance with the present invention.

Thus when a wheeled toy vehicle, such as JAKK Pacific, Inc.'s FLY WHEELS toy 30, the subject of a separate PCT patent application is launched, the wheeled toy vehicle 30 will travel upward approximately 90 degrees along the ramp 10 as shown in FIG. 15.

FIGS. 4-8 show various views of the side support structure 5. FIG. 4 is a side view of one of the support structure showing the groove 15 defined within the edge 4 of the support structure. FIG. 5 view of the side support structure 5 showing the openings 12 for the ends 27 of the cross braces 7 to be inserted into the openings 12. FIG. 6 is a top view of the ramp 5 showing the two side support structures connected at a top surface 16 of the ramp 10 by a cross brace 7. FIG. 7 is a bottom view of the side support structure of FIG. 8 a view along lines 7-7 of FIG. 5.

Figure 9:
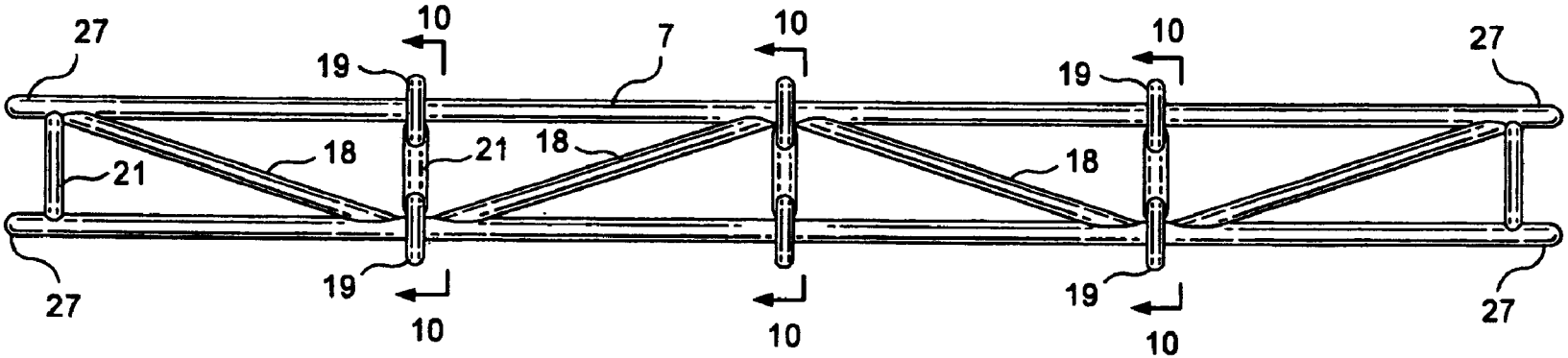
FIG. 9 is a top view of one of the connecting cross braces or trusses.
Figure 11:
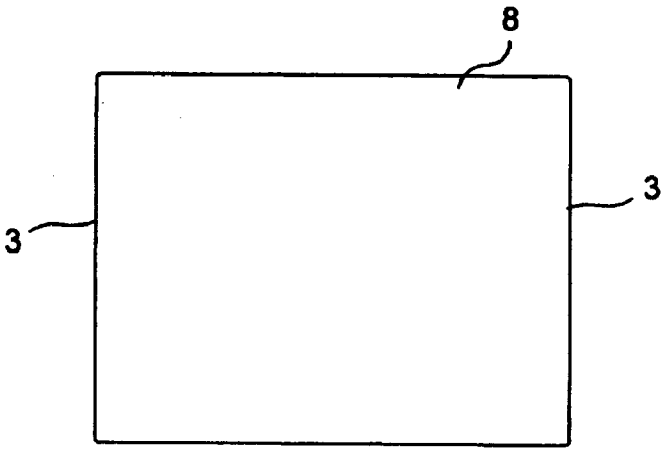
FIG. 11 is a front view of the ramp sheet.
Figure 10:
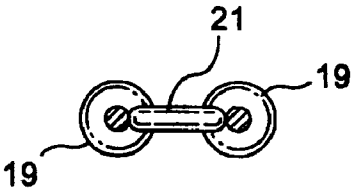
FIG. 10 is a sectional view along lines 9-9 of FIG. 8.

A cross brace structure 7 is shown in FIG. 9 showing ends 17. The cross brace structure 7 has a diagonal connecting elements 18 and vertical connecting elements 19. The vertical connecting elements are preferably formed of two circular shaped elements 19 and a vertical connecting piece 21 connecting the two circular pieces 19 as shown in FIGS. 9 and 10. A flexible sheet 8 is shown in FIG. 11 having edges 3 adapted to be inserted into the grooves of the edges 4 of the support structures 5 so that the flexible sheet 8 assumes the upwardly sloping curved shape of preferably approximately 90 degrees shown in FIG. 12.

Figure 13:
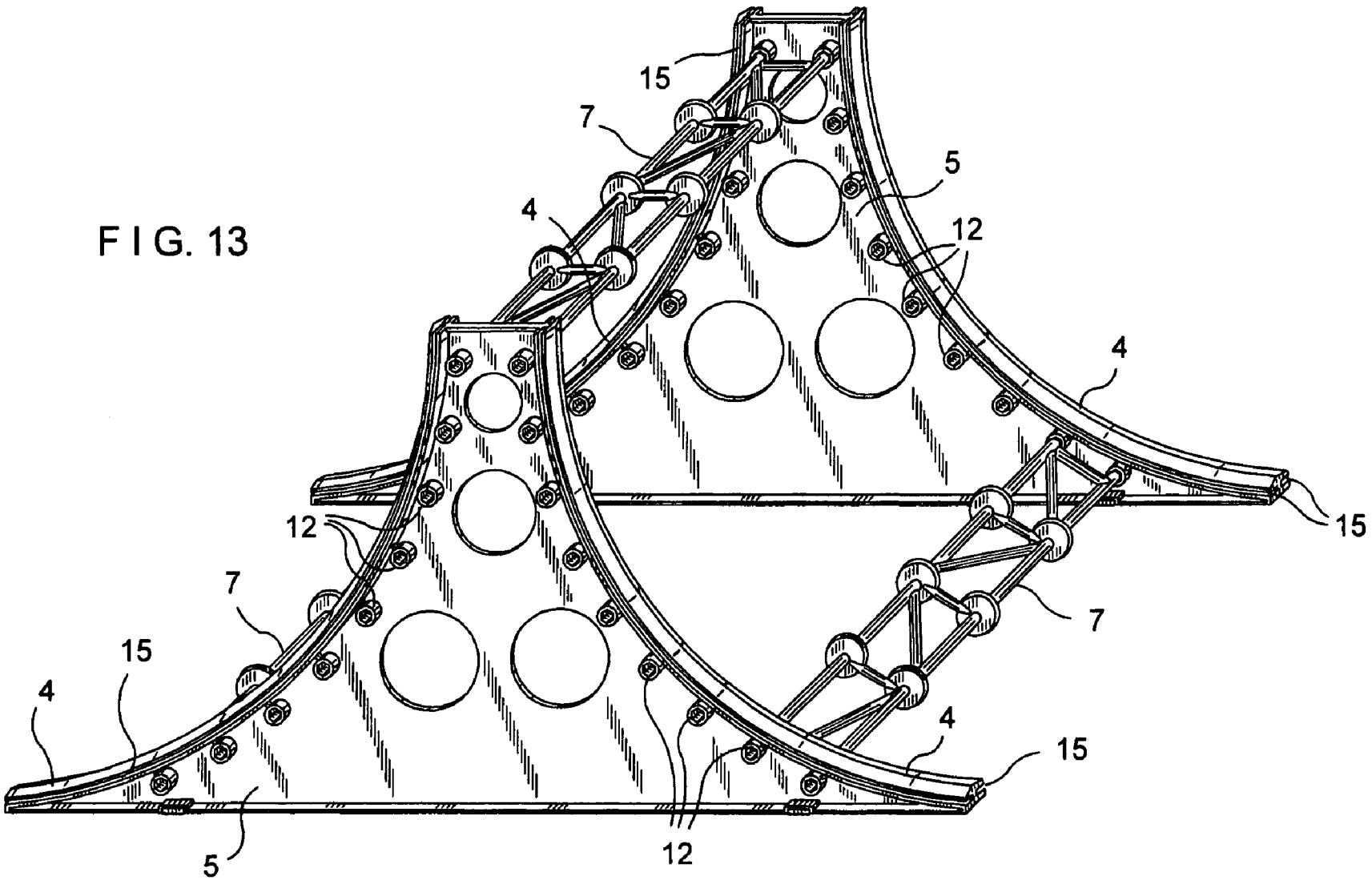
FIG. 13 is the ramp frame without the ramp sheet of the present invention.

FIG. 13 shows the ramp with the flexible sheets removed to illustrate the connection of the cross braces 7 to the side support structures 5.

Figure 14:
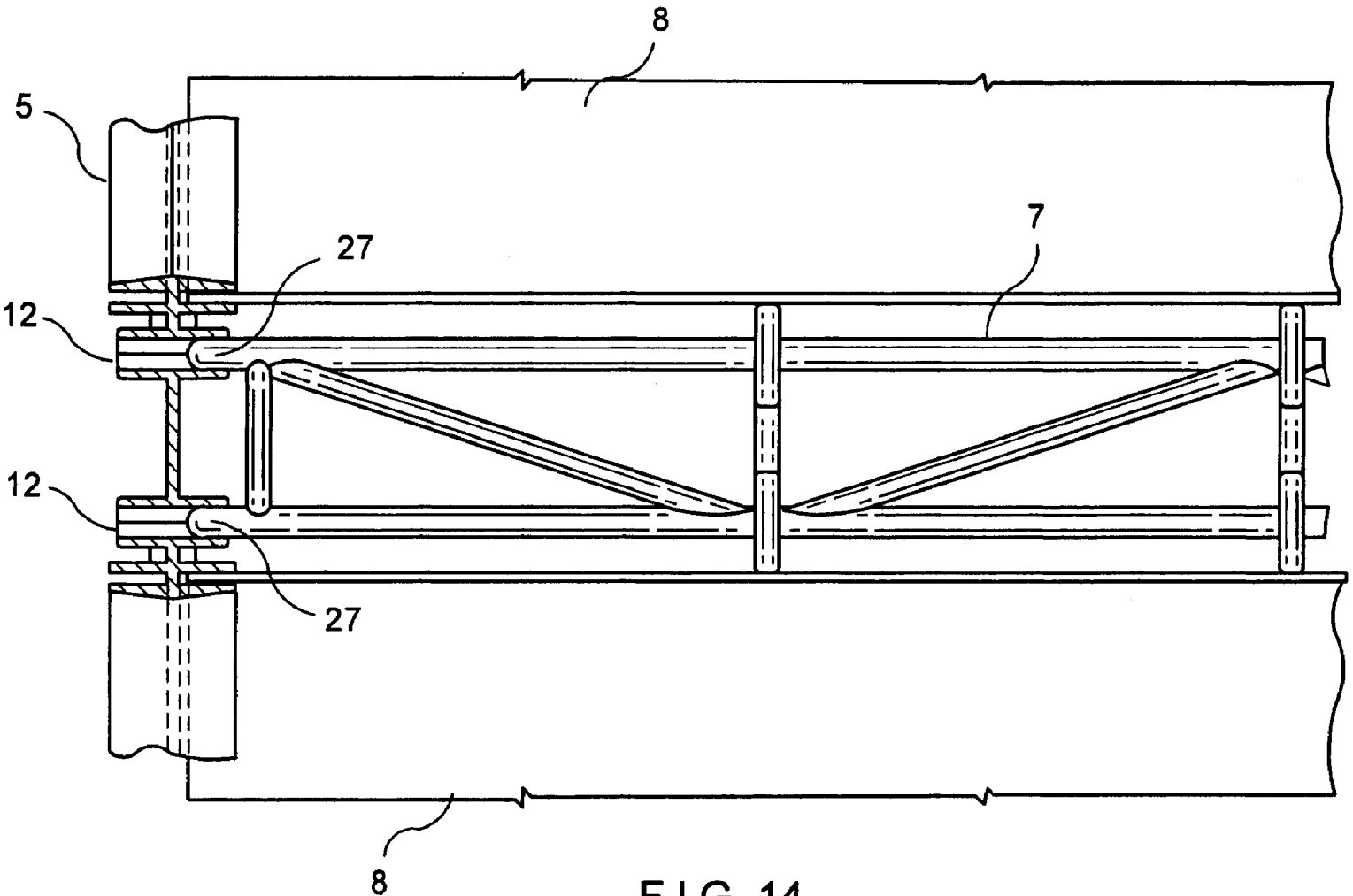
FIG. 14 is a sectional view taken along lines 13-13 of FIG. 2.

FIG. 14 shows a top sectional portion of the ramp showing a cross brace 7 connected to the side support structures 5.

Figure 17:
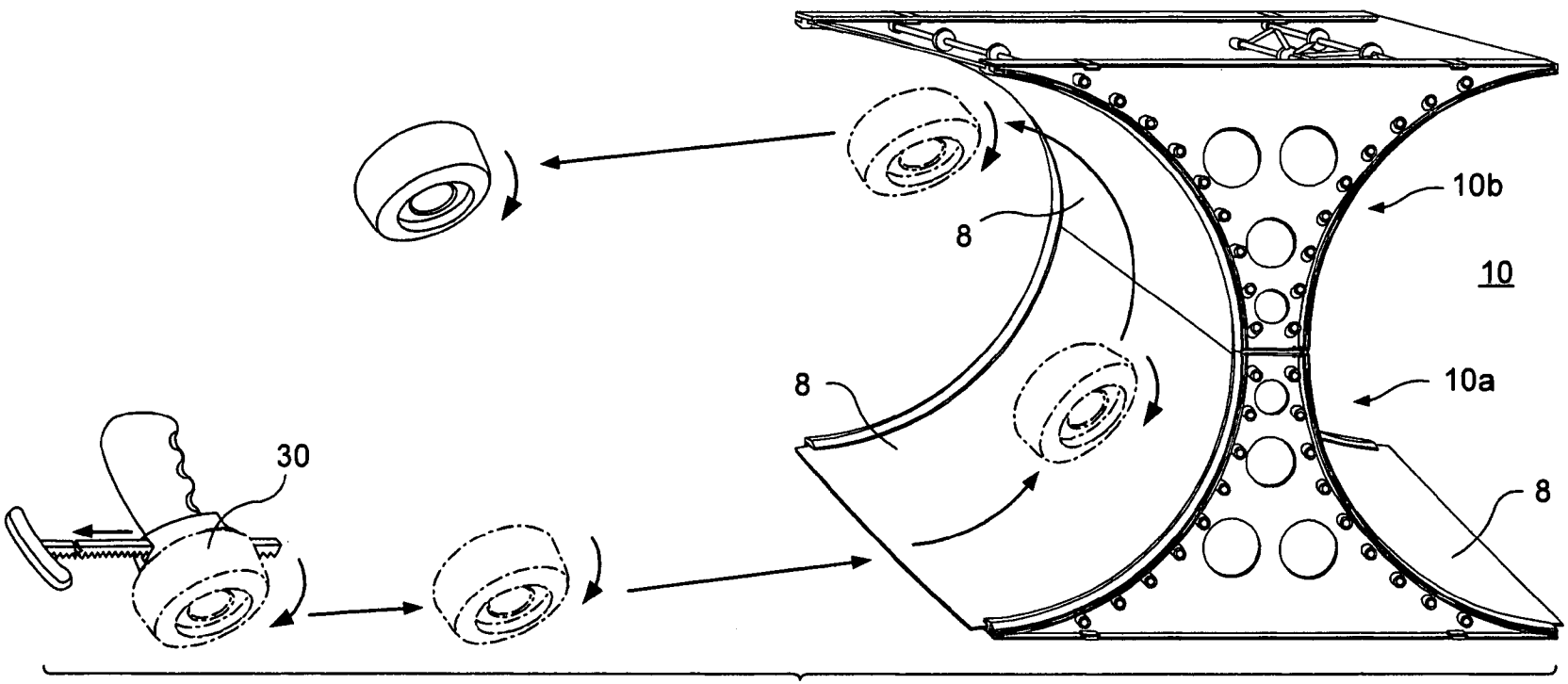
FIG. 17 illustrates the inverted C-shaped ramp and wheeled toy in use in the embodiment of FIG. 14.

FIGS. 16-17 illustrate a second embodiment of the invention. In the second embodiment two ramps 10*a*, 10*b* are used each comprising the components and assembled as described in the first embodiment. The two ramps 10 are connected together by placing the second ramp 10*b* upside down with respect to the first ramp 10*a* so that the second ramp's 10*b* top surface 24*b* lies on top of the top surface 24*a* of the first ramp 10*a* and is connected thereto so as to stay in place. The two ramps 10*a*, 10*b* are connected by a cross brace 7 having one end 27*a* going into a top opening 12*a* of the bottom ramp 10*a* and the other end 27*b* going into the bottom opening 12*b* of the top ramp 10*b* on each side of the side support structures 5. The result is a ramp 10 with preferably a 180 degree sloping curve as seen in FIG. 16 so that when a toy wheeled vehicle 30 such as JAKKS Pacific, Inc.'s FLY WHEELS toy is launched it will travel along the ramp at approximately a 180 degree initially upwardly sloping curve. The flexible sheets 8 of the two ramps 10*a*, 10*b* can be slid within their respective grooves 15 of their respective side support structures so that the overall ramp can have an adjustable slope of between approximately 5 degrees and 180 degrees.

Figure 18:
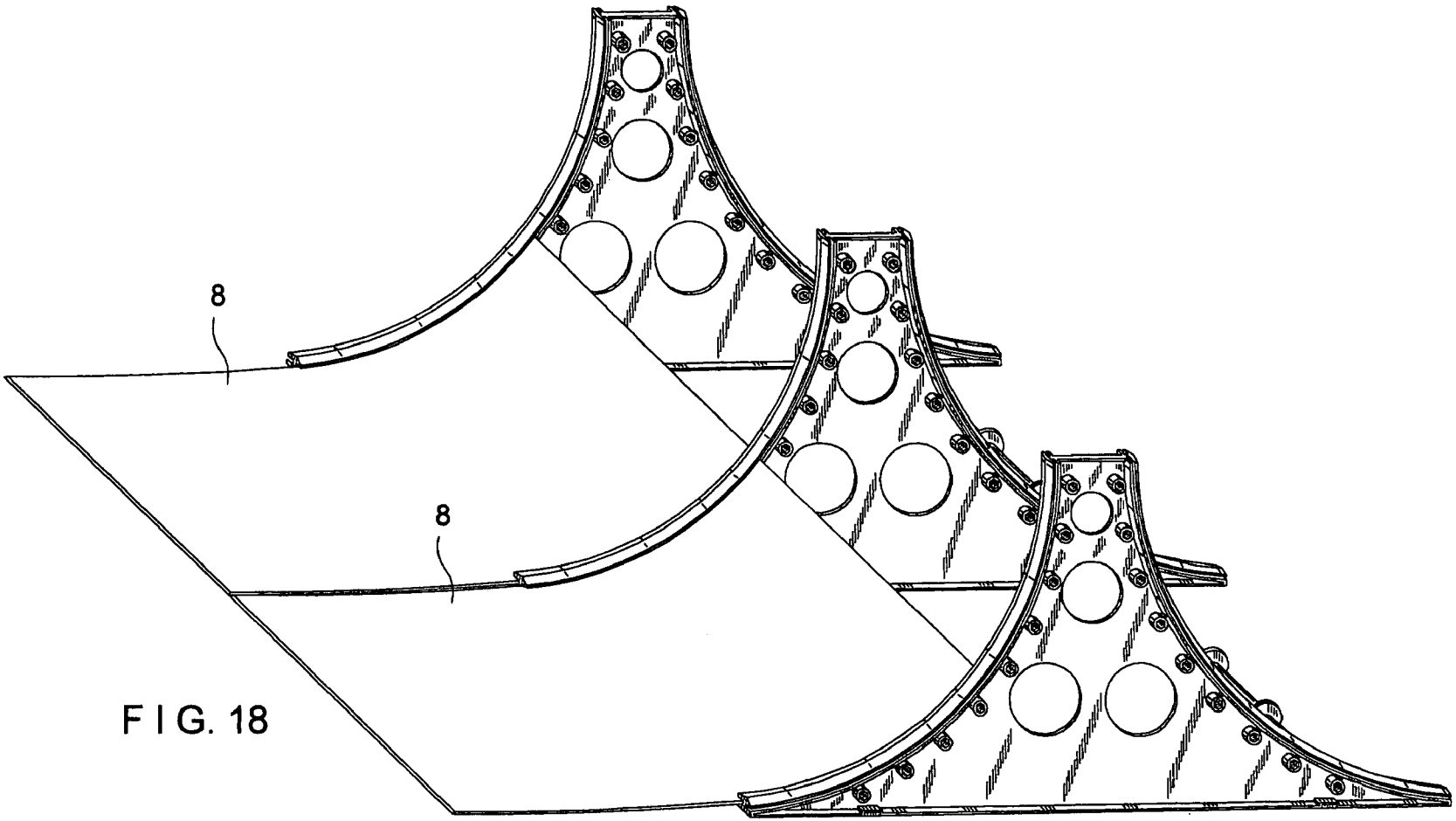
FIG. 18 illustrates a third embodiment of the present invention showing how additional ramps can be added in a side by side arrangement.

FIG. 18 shows a third embodiment of the invention in which additional ramps can be added on each side of the ramp embodiment of FIG. 1. The additional ramps 10 can be connected by cross braces connected to the openings of the side supports structures 5 of the two ramps 10 to be connected. In this way, a chain of ramps 10, in side by side connection, can be established. As many ramps 10 can be connected in this fashion as desired. In addition the second embodiment of FIG. 16 can be incorporated into this embodiment by adding a ramp turned upside down on top of each of the ramps connected side by side as desired and connected to each other by the cross braces 7.

I do not limit myself to any particular details of construction set forth in the specification and illustrated in the accompanying drawings, as the same refers to and sets forth only certain embodiments of the invention, and it is observed that the same may be modified without departing from the spirit and scope of the claimed invention.

The invention claimed is:

1. A wheeled toy vehicle ramp, comprising:

two side support structures having grooves defined within upwardly sloping curved edges of said support structures, said support structures having apertures and being adapted to be connected to each other;

a plurality of cross braces, each having ends adapted to be inserted into said apertures to connect said two side support structures to each other;

a flexible sheet having two edges, each of said two edges adapted to slidingly fit within a corresponding one of said grooves so that said flexible sheet is entirely supported in said ramp by placement within said grooves of said side support structures and said flexible sheet to conform to a shape of said upwardly sloping curved edges to assume an upwardly sloping curved shape thereby forming an upwardly sloping curved ramp.

2. The wheeled toy vehicle ramp according to claim 1 wherein each of said two support structures includes raised circular housings and each said raised housing has one of said apertures therein.

3. The wheeled toy vehicle ramp according to claim 1 wherein said flexible sheet is made of plastic.

4. The wheeled toy vehicle ramp according to claim 1 wherein ramp has an upwardly curved slope of approximately 90 degrees.

5. The ramp according to claim 1 wherein said plurality of cross braces including three cross braces, a first cross brace adapted to connect the top surface of said two sided support structures to each other, a second cross brace adapted to connect a lower front surface of said support structure and a third cross brace adapted to connect a lower rear surface of said support structure to each other.

6. The wheeled toy vehicle ramp according to claim 1, wherein said ramp has a front surface, a rear surface, and a top surface, and said plurality of cross braces connect said side support structures to each other at a lower portion of said front surface, at a lower portion of rear surface and at said top surface of said ramp.

7. The wheeled toy vehicle ramp according to claim 6 wherein said first ramp and said second ramp are connected to each other by one of said cross braces.

8. A wheeled toy vehicle ramp, comprising a first ramp structure and a second ramp structure, each of said ramp structures having a top surface and being formed of two side support structures having grooves defined on upwardly sloping curved edges of said support structures, said support structures having apertures and being adapted to be connected to each other;

a plurality of cross braces, each having ends adapted to be inserted into said apertures to connect said two side support structures to each other;

a flexible sheet having two edges, each of said two edges adapted to slidingly fit within a corresponding one of said grooves so that said flexible sheet is entirely supported in said ramp by placement within said grooves of said side support structures and said flexible sheet to conform to a shape of said upwardly sloping curved edges to assume an upwardly sloping curved shape thereby forming an sloping curved ramp wherein said second ramp structure is turned upside down and placed on top of said first ramp structure so that the top surface of second ramp structure rests on top of the top surface of said first ramp structure thereby forming an inverted C-shaped ramp structure having an approximated 180 degree curved slope.

9. The wheeled toy vehicle ramp according to claim 8 wherein each of said support structures includes raised circular housings and each said raised housing has one of said apertures therein.

10. The wheeled toy vehicle ramp according to claim 8 wherein said flexible sheet is made of plastic.

11. The ramp according to claim 8 wherein said plurality of cross braces for each said ramp includes each ramp having a first cross brace adapted to connect a lower front surface of said support structures to each other, a second cross brace adapted to connect a lower rear surface of said support structure to each other and said two ramps further being connected together by a third cross brace adapted to connect the top surfaces of said two ramps together when said second ramp is placed on top of said first ramp.

12. The wheeled toy vehicle ramp according to claim 11 wherein said flexible sheet is made of plastic.

13. The ramp according to claim 11 wherein said plurality of cross braces for each said ramp includes each ramp having a first cross brace adapted to connect a lower front surface of said support structures to each other, a second cross brace adapted to connect a lower rear surface of said support structure to each other and said two ramps further being connected together by a third cross brace adapted to connect the top surfaces of said two ramps together when said second ramp is placed on top of said first ramp.

14. The wheeled toy vehicle ramp according to claim 11 wherein said flexible sheets can slide up or down within said respective grooves of said respective side support structures and at least some of said plurality of cross braces can be placed in correspondingly, appropriate openings in said respective side support structures to support said flexible sheets in their positions so that said ramps can adjustably vary its sloping surface.

15. The wheeled toy vehicle ramp according to claim 11 wherein the two ramps are connected by said third cross brace having one end going into a top opening of the bottom ramp and another end going into the bottom opening of the top ramp on each side of said side support structures.

16. The wheeled toy vehicle ramp according to claim 11, wherein each of said ramps has a front surface, a rear surface, and a top surface, and said plurality of cross braces connect said side support structures to each other at a lower portion of said front surface, at a lower portion of said rear surface.

17. The wheeled toy vehicle ramp according to claim 11 wherein the two ramps are connected by said third cross brace having one end going into a top opening of the bottom ramp and another end going into the bottom opening of the top ramp on each side of said side support structures.

18. The wheeled toy vehicle ramp according to claim 17 wherein said ramp can have a slope varying from approximately 5 degrees to 180 degrees.

19. The wheeled toy vehicle ramp according to claim 8, wherein each of said ramps has a front surface, a rear surface, and a top surface, and said plurality of cross braces connect said side support structures to each other at a lower portion of said front surface, at a lower portion of rear surface.

* * * * *